US006116334A

United States Patent [19]

Di Tomaso

[11] Patent Number: 6,116,334

[45] Date of Patent: Sep. 12, 2000

[54] INTEGRAL END COVER FOR CONDENSER OR EVAPORATOR

[75] Inventor: Peter Di Tomaso, Lawrenceville, Ga.

[73] Assignee: Danfoss, Inc., Rockford, Ill.

[21] Appl. No.: 09/071,979

[22] Filed: May 4, 1998

[51] Int. Cl.[7] ..... F28F 9/007

[52] U.S. Cl. ..... 165/134.1; 165/149

[58] Field of Search ..... 165/149, 150, 165/134.1

[56] References Cited

U.S. PATENT DOCUMENTS

| | | | |
|---|---|---|---|
| 844,685 | 2/1907 | Long | 165/150 |
| 1,788,068 | 1/1931 | Scott | 165/149 |
| 1,832,147 | 11/1931 | Soule | 165/150 X |
| 4,483,392 | 11/1984 | Korsmo et al. | 165/150 |
| 4,729,292 | 3/1988 | Marton | 98/40.01 |
| 5,159,883 | 11/1992 | Rosenberg | 108/111 |

FOREIGN PATENT DOCUMENTS

| | | | |
|---|---|---|---|
| 2-208496 | 8/1990 | Japan | 165/149 |

*Primary Examiner*—Allen Flanigan
*Attorney, Agent, or Firm*—Lee, Mann, Smith, McWilliams, Sweeney & Ohlson

[57] ABSTRACT

An end cover for protecting heat exchanger tubing of a condenser or an evaporator. The end cover comprises a cover support and a series of flanges extending from the cover support. The flanges are connected so that they can be bent relative to one another and the cover support in order to extend over and protect one end of the heat exchanger tubing. Similar end covers are provided for each end of the heat exchanger tubing.

13 Claims, 2 Drawing Sheets

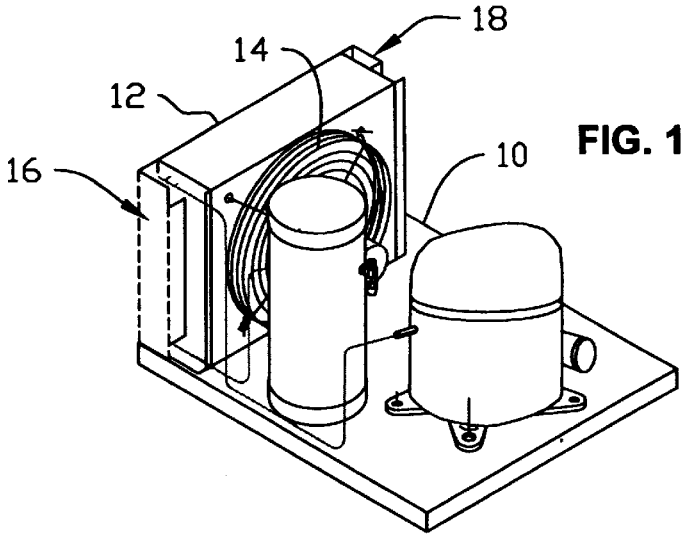
FIG. 1
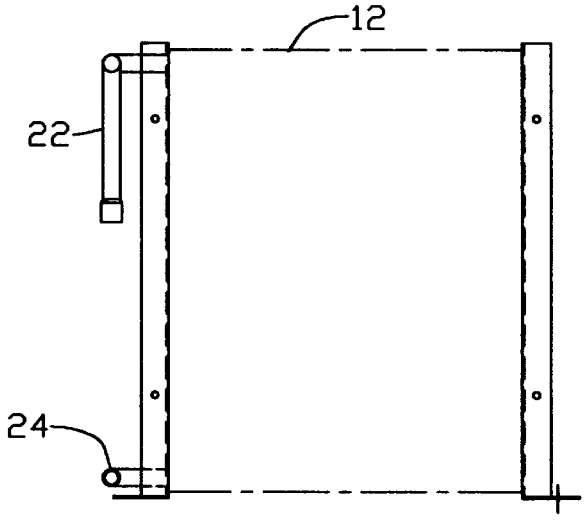
FIG. 2
FIG. 3
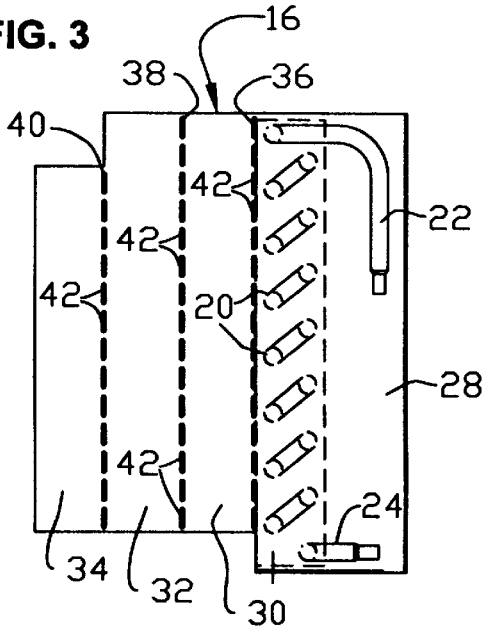
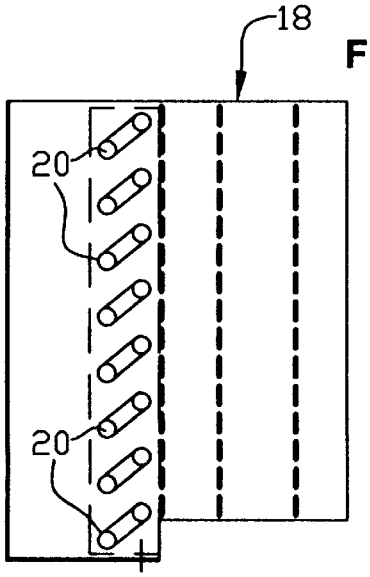
FIG. 4

INTEGRAL END COVER FOR CONDENSER OR EVAPORATOR

BACKGROUND OF THE INVENTION

This invention relates to heat exchangers used in connection with compressor units, such as evaporators and condensers, and in particular to an end cover for protecting the heat exchanger tubing of the condenser or evaporator.

Current standards require that tubing of refrigerant-containing parts of evaporators and condensers, be protected in some matter from inadvertent damage. The usual method for protecting the tubing is to locate it in a protective housing, and provide separate covers for each end of the housing. The reason that separate covers are provided is that the tubing is mounted in the housing and the ends must be accessible for forming of the tubing, brazing of the tubing, and testing of the tubing. The end covers are then applied to complete the housing unit.

One problem with separate end covers is that they are expensive to make and to install. The purpose of the present invention is to provide end covers that meet all standards, yet reduce the amount of material involved and the labor for their installation.

SUMMARY OF THE INVENTION

The invention provides an end cover for protecting heat exchanger tubing of a condenser or evaporator, with the end cover comprising a cover support, a first flange extending from the cover support, and first means connecting the first flange to the cover support along a substantially linear union, the first means being bendable at least once so that the first flange can be bent from a first orientation relative to the cover support to a second orientation. A second flange is provided, extending from the first flange. Second means is provided connecting the second flange to the first flange along a substantially linear union, the second means being bendable at least once so that the second flange can be bent from a first orientation relative to the first flange to a second orientation.

In accordance with the preferred form of the invention, the cover support and the flanges are integral, and each means connecting comprises a line of weakening. Preferably, the line of weakening comprises a plurality of spaced slots.

The preferred form of the invention also includes a third flange which extends from the second flange, with third means connecting the third flange to the second flange along a substantially linear union with the third means being bendable at least once so that the third flange can be bent from a first orientation relative to the second flange to a second orientation.

In accordance with the preferred form of the invention, an end cover is provided for protecting the heat exchanger tubing at opposite ends of the housing for the heat exchanger tubing. Each end cover is formed in the same manner.

In the method according to the invention, first a sheet is formed, comprising the cover support, a first flange extending from the cover support and a second flange extending from the first flange. A first bendable connection is formed between the first flange and the cover support, and a second bendable connection is formed between the second flange and the first flange. The cover support is then installed on one end of the condenser or evaporator proximate the heat exchanger tubing, and the bendable connections are bent so that the first flange extends approximately 90° to the cover support and the second flange extends approximately 90° to the first flange. When a third flange is provided, it is formed in the same manner and is bent approximately 90° to the second flange. The bendable connections are preferably formed as the series of spaced slots.

BRIEF DESCRIPTION OF THE DRAWINGS

The invention is described in greater detail in the following description of an example embodying the best mode of the invention, taking in conjunction with the drawing figures, in which:

FIG. 1 is a perspective view of a compressor unit having a heat exchanger employing end covers according to the invention, FIG. 2 is an elevational illustration of the housing for heat exchanger tubing for an evaporator or a condenser before final installation of the end covers according to the invention, FIG. 3 is an end elevational illustration of the left side of FIG. 2, showing the end cover according to the invention before it has been bent to encompass the end of the heat exchanger tubing, FIG. 4 is a view similar to FIG. 3, but of the right side of FIG. 2, FIGS. 5A through 5E illustrate, from the top plan view, the end cover illustrated in FIG. 3 as the end cover is initially in place before bending and as it is bent to form the end cover about the heat exchanger tubing.

DESCRIPTION OF AN EXAMPLE EMBODYING THE BEST MODE OF THE INVENTION

A compressor unit is designated generally at 10 in FIG. 1. The compressor unit ten may be conventional, and therefore its various elements are not described in detail. The compressor unit 10 does include at least one housing 12 having heat exchanger tubing mounted therein, and a fan 14 is provided for cooling the heat exchanger tubing. All of this is conventional.

Figure 6:
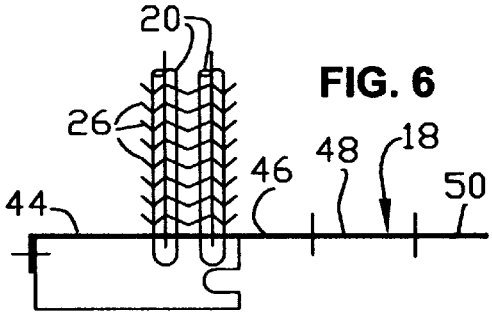
FIG. 6 illustrates, from a top plan view, the end cover in FIG. 4 before bending, with the bending steps being identical, but in mirror image, to the bending steps shown in FIG. 5B through 5E.

The housing 12 includes opposite end covers according to the present invention. One end cover 16 is illustrated, and the second end cover 18, which is on the opposite end of the housing 12, is substantially identical in configuration and is described in detail below in relation to FIGS. 4 and 6.

The end cover 16 (FIG. 1, 3 and 5) and the opposite end cover 18 (FIGS. 4 and 6) are installed on opposite ends of the heat exchanger tubing housing 12. As is conventional, the housing 12 includes continuous length of heat exchanger tubing 20 extending from an inlet header 22 to an outlet header 24. The heat exchanger tubing 20 can be formed in a conventional fashion with spaced heat transfer fins 26 to aid the dissipation of heat.

Figure 5A:
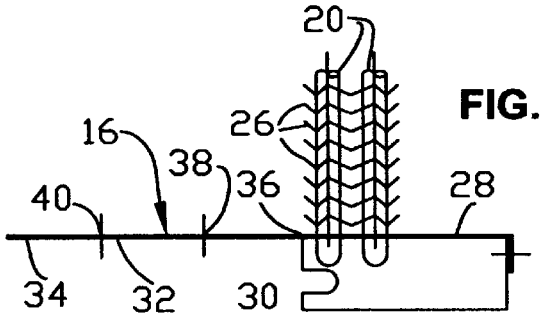
Figure 5B:
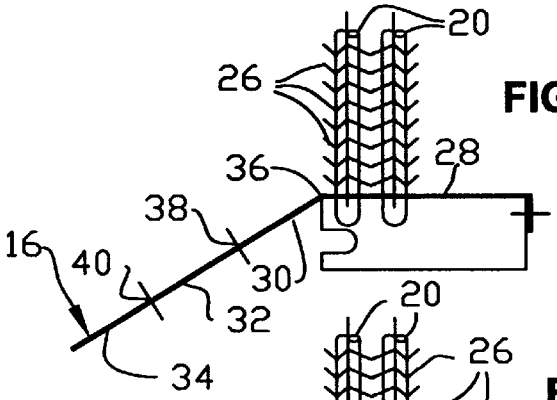
Figure 5C:
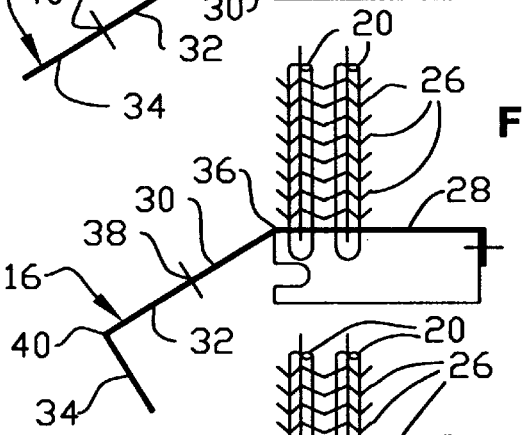
Figure 5D:
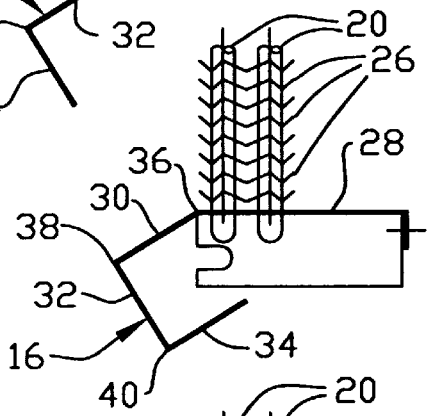

The end cover 16 comprises a flat sheet having four portions, a cover support 28, a first flange 30, a second flange 32 and a third flange 34. Preferably, the end cover 16 is an integral unit, with the cover support 28 and flanges 30 through 34 being joined to one another along a substantially linear union. To this end, a line of weakening 36 is provided between the cover support 28 and the first flange 30. Similarly, a line of weakening 38 is provided between the first flange 30 and the second flange 32, and a line of weakening 40 is provided between the second flange 32 and the third flange 34. For ease in illustrating the location of the lines of weakening 36 through 40, lines perpendicular to the end cover 16 are illustrated in FIG. 5A through 5C although, of course, no such perpendicular lines actually exist.

Each of the lines of weakening 36 through 40 is preferably composed of a series of elongated slots 42. As illustrated in FIG. 3, the slots 42 occupy the majority of each line of weakening, leaving only small bridging portions of the material of the end cover 16 between them. Since the end cover 16 is preferably formed of metal, the end cover 16 is therefore bendable along each of the lines 36 through 40.

While the series of slots 42 preferably form the lines of weakening, and while the end cover 16 is preferably formed of metal, different materials can be used, and different means of forming lines of weakening can be provided. For example, the end covers could be formed of plastics or other bendable materials, and the lines of weakening can be scores, perforations, or anything similar, as would be apparent to one skilled in the art.

In formation of the end cover 16, it is first formed from an appropriate sheet of material, having the cover support 28, first flange 30, second flange 32 and third flange 34. Also, the lines of weakening 36, 38 and 40 are formed in the flat sheet. Then, the end cover 16 is located at one end of the housing 12 and the tubing 20 is installed. The cover support thus also comprises part of the support for the heat exchanger tubing 20. Thereafter, as illustrated in FIG. 5B through 5E, a series of bends along the lines of weakening 36 through 40 is made so that the end cover 16 ultimately forms a cap which surrounds the end returns of the heat exchanger tubing 20.

The end cover 18 is formed in a similar fashion. It is comprised of a cover support 44, a first flange 46, a second flange 48 and a third flange 50. Lines of weakening 52, 54 and 56 are provided, with each line of weakening composed of a series of slots 58. The end cover 18 is installed in exactly the same manner as the end cover 16 is installed, forming a cap for the opposite return ends of the heat exchanger tubing 20.

Figure 5E:
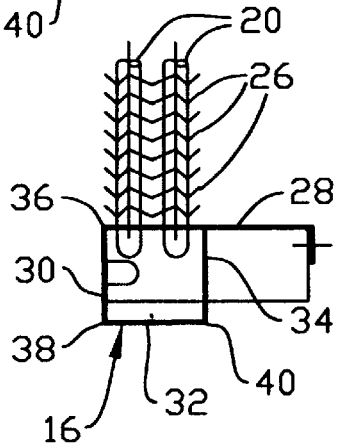

Because the end covers 16 and 18 are preferably formed of metal with the lines of weakening between the various elements of the end covers, the flanges are bendable at least once from the first flat orientation illustrated in FIGS. 3, 4, 5A and 6 to a second orientation relative to one another, with the bends being approximately 90°, as best illustrated in FIG. 5E.

The invention provides a simple and inexpensive end cover for each end of the heat exchanger tubing 20 of a condenser or evaporator. It is also easy to install, since each of the end covers 16 and 18 can be bent by hand along the lines of weakening to form the closed end covers. No fasteners or other means of retaining the end covers in their folded orientations are necessary.

Various changes can be made to the invention without departing from the spirit thereof or scope of the following claims.

What is claimed is:

1. An end cover for protecting heat exchanger tubing of a condenser or an evaporator, comprising, a. a cover support, b. a first flange extending from said cover support and extending substantially coextensive with a longitudinal dimension of said cover support, c. first means connecting said first flange to said cover support along a substantially linear union, said first means being bendable at least once so that said first flange can be bent from a first orientation relative to said cover support to a second orientation d. a second flange extending from said first flange, and e. second means connecting said second flange to said first flange along a substantially linear union, said second means being bendable at least once so that said second flange can be bent from a first orientation relative to said first flange to a second orientation.

2. An end cover according to claim 1, in which said cover support and said flanges are integral, and each means connecting comprises a line of weakening.

3. An end cover according to claim 2, in which said line of weakening comprises a plurality of spaced slots.

4. An end cover according to claim 1 including a third flange extending from said second flange and third means connecting said third flange to said second flange along a substantially linear union, said third means being bendable at least once so that said third flange can be bent from a first orientation relative to said second flange to a second orientation.

5. An end cover according to claim 4 in which said cover support and said flanges are integral, and each means connecting comprises a line of weakening.

6. An end cover according to claim 5 in which said line of weakening comprises a plurality of spaced slots.

7. An end cover according to claim 1 in which said cover support further comprises a support for the heat exchanger tubing.

8. In a cooling apparatus having means for exchanging heat, including heat exchanger tubing for a condenser or an evaporator and a housing for the heat exchanger tubing including support for the heat exchanger tubing, the improvement comprising, opposite end covers for protecting the heat exchanger tubing, each end cover comprising a. a first flange extending from said support and extending substantially coextensive with a longitudinal dimension of said support, b. first means connecting said first flange to said support along a substantially linear union, said first means being bendable at least once so that said first flange can be bent from a first orientation relative to said support to a second orientation, c. a second flange extending from said first flange, and d. second means connecting said second flange to said first flange along a substantially linear union, said second means being bendable at least once so that said second flange can be bent from a first orientation relative to said first flange to a second orientation.

9. An end cover according to claim 8, in which said support and said flanges are integral, and said each means connecting comprises a line of weakening.

10. An end cover according to claim 9, in which said line of weakening comprises a plurality of spaced slots.

11. An end cover according to claim 8 including a third flange extending from said second flange and third means connecting said third flange to said second flange along a substantially linear union, said third means being bendable at least once so that said third flange can be bent from a first orientation relative to said second flange to a second orientation.

12. An end cover according to claim 11, in which said support and said flanges are integral, and said each means connecting comprises a line of weakening.

13. An end cover according to claim 12, in which said line of weakening comprises a plurality of spaced slots.

* * * * *